US005959394A

United States Patent [19]

Lin

[11] Patent Number: 5,959,394

[45] Date of Patent: Sep. 28, 1999

[54] WIRE CONNECTING STRUCTURE FOR LAMP HOLDERS

[76] Inventor: Chien-Yu Lin, P.O. Box 82-144, Taipei, Taiwan

[21] Appl. No.: 08/955,118

[22] Filed: Oct. 21, 1997

[51] Int. Cl.[6] ..... H01J 5/48; H01J 5/50; H01R 4/24; H01R 4/26

[52] U.S. Cl. ..... 313/318.1; 313/318.01; 313/318.05; 439/417; 439/419

[58] Field of Search ..... 318/0.01–10, 493, 318/634; 439/417, 418, 419, 699.1, 699.2, 611–619, 734

[56] References Cited

U.S. PATENT DOCUMENTS

| | | | |
|---|---|---|---|
| 2,983,838 | 5/1961 | Pechy | 313/318.01 |
| 4,100,448 | 7/1978 | Chipner et al. | 313/318.01 X |
| 4,820,956 | 4/1989 | Slobodzian et al. | 313/318.01 X |
| 4,877,992 | 10/1989 | Devir | 313/318.1 |
| 5,601,448 | 2/1997 | Poon | 439/419 |
| 5,701,051 | 12/1997 | Lin | 313/419 |
| 5,779,497 | 7/1998 | Hale et al. | 439/419 |

*Primary Examiner*—Sandra O'Shea
*Assistant Examiner*—Mack Haynes
*Attorney, Agent, or Firm*—A & J

[57] ABSTRACT

A wire connecting structure for lamp holders includes a lamp holder cover and a retaining element. The lamp holder cover may be directly fitted on an upper end of alamp holder and is provided with a coupling slot for receiving the retaining element and a wire. When the retaining element is assembled to the lamp holder cover, it presses the wire downwardly so that the wire is pierced by a pointed end of an electrically conductive terminal of the lamp holder to make the electrical connection.

1 Claim, 3 Drawing Sheets

WIRE CONNECTING STRUCTURE FOR LAMP HOLDERS

BACKGROUND OF THE INVENTION

1. Field of the Invention

This invention relates to an improved wire connecting structure for lamp holders.

2. Description of the Prior Art

In known large-size light bulbs, the wires are respectively secured at the positions of the two poles at the upper portion of the lamp holder and are secured in place by screws. The copper filaments of the wires are exposed and wound on the screws to achieve electrical connection. However, in such prior method, the distal ends of the wires have first of all be stripped to expose the copper filaments which are then manually wound on the screws, which is very inconvenient and costly. Besides, securing the wires by screws is not very effective and may lead to poor electrical contact.

SUMMARY OF THE INVENTION

This invention relates to an improved wire connecting structure for lamp holders.

A primary object of the present invention is to provide a wire connecting structure for lamp holders to permit easy wire positioning and electrical connection.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

Many other advantages and features of the present invention will become manifest to those versed in the art upon making reference to the detailed description and the accompanying sheets of drawings in whch a preferred structural embodiment incorporating the principles of the present invention is shown by way of illustrative example.

DETAILED DESCRIPTION OF THE PREFERRED EMBODIMENT

Figure 1:
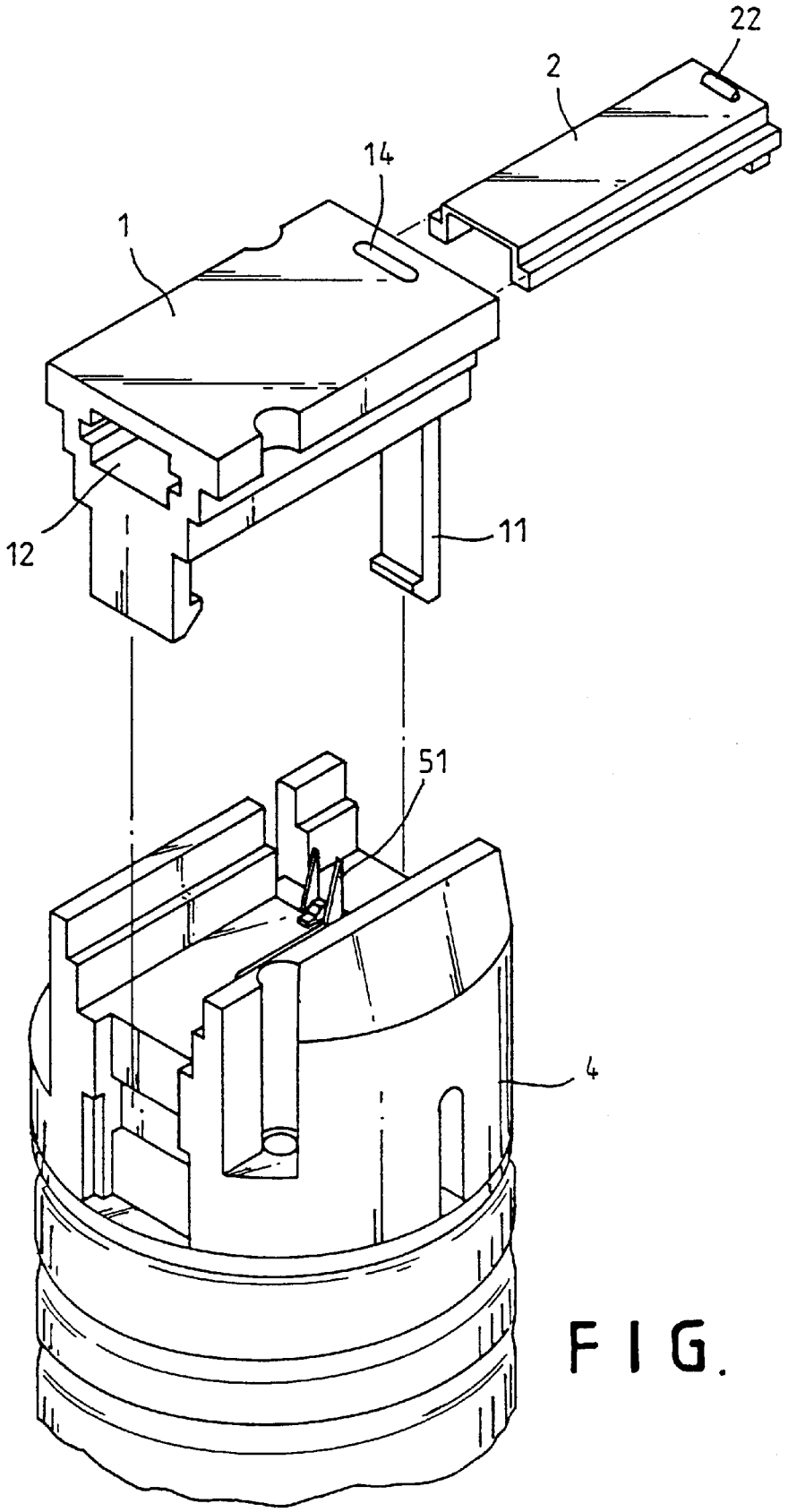
FIG. 1 is a perspective exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
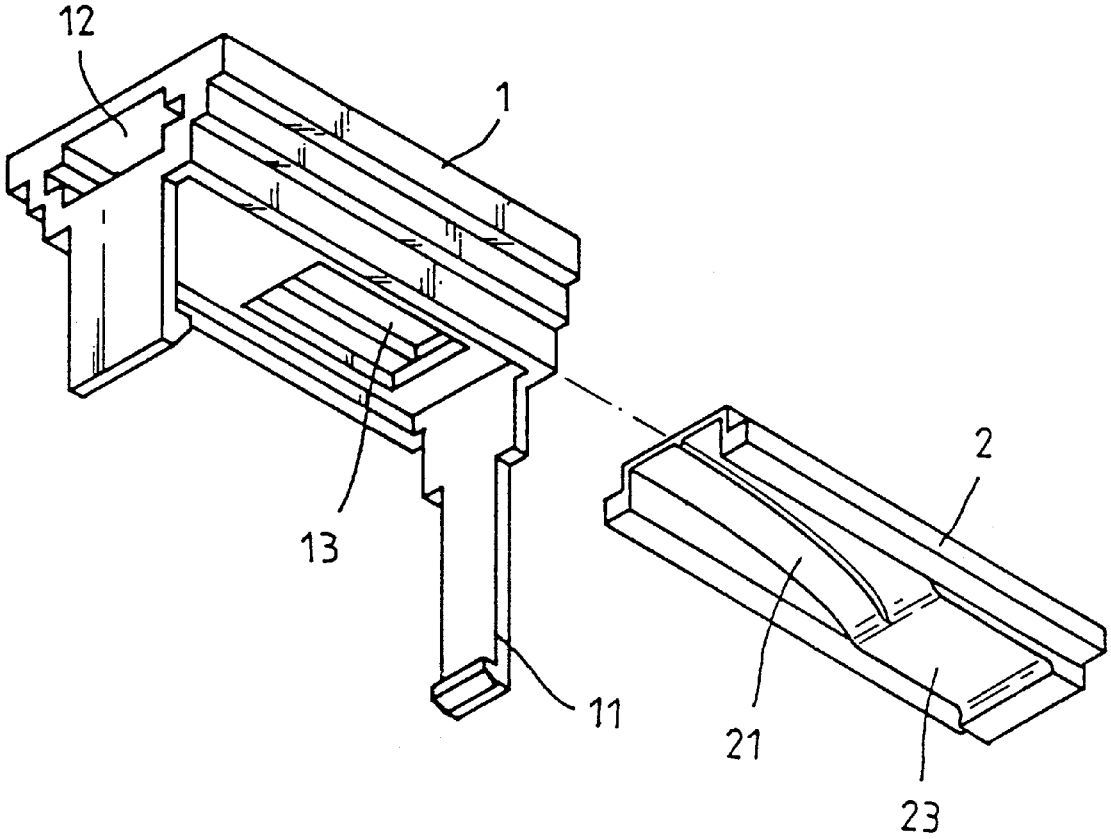
FIG. 2 is a perspective view of the present invention taken from another angle.

With reference to the drawings and in particular to FIGS. 1 and 2 thereof, the present invention essentially comprises a lamp holder cover 1 and a retaining element 2. Both sides of the lamp holder cover 1 are provided with respective fastening lugs 2 that orient downwardly such that they may effectively fasten to an upper portion of a lamp holder 4 to constitute a firm connection. The lamp holder cover 1 is provided with horizontally through coupling slot 12 and an opening 13 at a lower portion. The lamp holder 4 has an electrically conductive terminal 5 therein, the terminal 5 having a pointed end 51 that projects from the upper side of the lamp holder 4 and may just extend into the opening 13. The retaining element 2 may insert into the coupling slot 12 and has a positioning rim 22 at an upper portion that that engages a positioning hole 14 of the lamp holder cover 1. A lower end of the retaining element 2 is provided with a curved surface 21 and an engaging surface 23.

Figure 3:
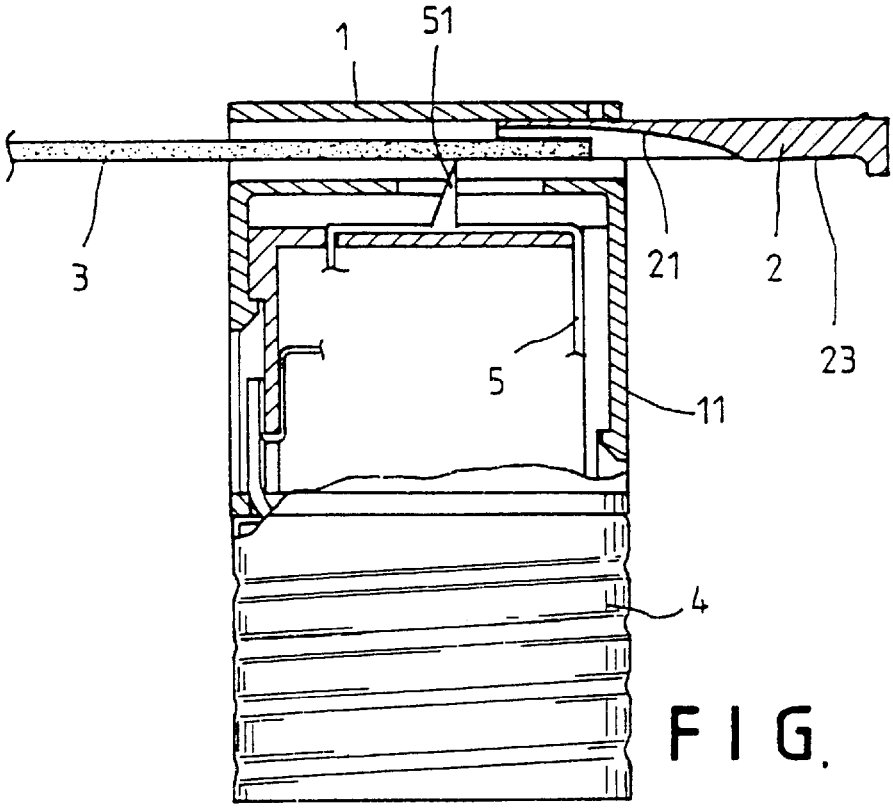
FIG. 3 is a sectional plan view of the present invention.
Figure 4:
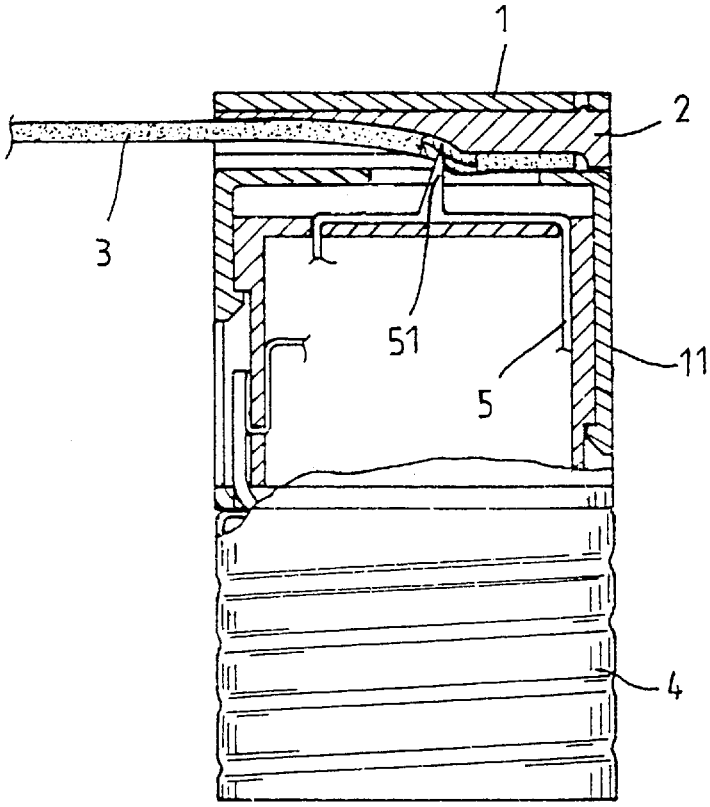
FIG. 4 is a sectional assembled plan view of the present invention.

With reference to FIGS. 3 and 4, to assemble a wire 3 to the lamp holder 4, the wire 3 and the retaining element 2 are respectively inserted into the coupling slot 12 via its two ends. The curved surface 21 serves as a guide so that the distal end of the wire 3 is clamped by the engaging surface 23 and the internal plane of the lamp holder cover 1, thus securing firm assembly. In addition, under the pressure of the curved surface 21, the wire 3 orients upwardly and is pierced by the pointed end 51 of the terminal 5 which is then electrically connected with the electrically conductive copper filaments inside the wire 3.

In summary, the present invention provides a very convenient way of assembling wires for lamp holders. The user only need to insert the wire and the retaining element of the invention into the ends of the lamp holder cover to secure the wire in order to achieve the object of wire connection.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A wire connecting structure for lamp holders, comprising a lamp holder, a lamp holder cover, and a retaining element, said lamp holder having an electrically conductive terminal therein, said terminal having a pointed end that projects from an upper side of said lamp holder, said lamp holder cover having two fastening lugs at both sides thereof, said fastening lugs being adapted to engageably secure at the upper side of said lamp holder, said lamp holder cover being further provided with a horizontally through coupling slot, and an opening at a bottom end thereof, said retaining element being provided with both a curved surface and an engaging surface at a lower end surface thereof for insertion into said coupling slot of said lamp holder cover, said engaging surface clamping a distal end of a wire while said curved surface presses the wire downwardly so that the wire is pierced by said pointed end of said terminal inside said lamp holder to make the electrical connection.

* * * * *